US006695154B2

(12) United States Patent
Jacobs

(10) Patent No.: US 6,695,154 B2
(45) Date of Patent: Feb. 24, 2004

(54) SYSTEM AND APPARATUS FOR ENHANCED SUPPORT, STORAGE, AND DISPLAY OF RECREATIONAL BOARDS

(76) Inventor: Amy M. Jacobs, 18301 8$^{th}$ Ave. NW., Shoreline, WA (US) 98133

( * ) Notice: Subject to any disclaimer, the term of this patent is extended or adjusted under 35 U.S.C. 154(b) by 0 days.

(21) Appl. No.: 10/128,945

(22) Filed: Apr. 22, 2002

(65) Prior Publication Data

US 2003/0196973 A1 Oct. 23, 2003

(51) Int. Cl.$^{7}$ ..... A41F 7/00; A41F 5/08
(52) U.S. Cl. ..... 211/85.7; 211/106
(58) Field of Search ..... 211/106, 85.7; D6/552

(56) References Cited

U.S. PATENT DOCUMENTS 3,421,725 A * 1/1969 Glass ..... 211/70.5
D310,479 S * 9/1990 Speetzen ..... D6/566
5,316,155 A * 5/1994 Collins et al. ..... 211/87.01
5,390,837 A * 2/1995 Ruffolo, Jr. ..... 248/205.6
5,441,161 A * 8/1995 Merl ..... 211/57.1
2002/0113183 A1 * 8/2002 Mattesky ..... 211/59.1

FOREIGN PATENT DOCUMENTS

EP 0063104 A1 * 10/1982 ..... A63C/11/02

* cited by examiner

*Primary Examiner*—Daniel P. Stodola
*Assistant Examiner*—Erica B Harris
(74) *Attorney, Agent, or Firm*—Merchant & Gould P.C.; Joshua W. Korver

(57) ABSTRACT

A rack for supporting and displaying recreational boards wherein at least a portion of design features of each of the recreational boards is simultaneously available for visual inspection. The rack includes mounting members, an elongated support member, and securing members. The angle of and distance between each securing member is such that at least a portion of design features for each recreational board is simultaneously visible.

19 Claims, 4 Drawing Sheets

SYSTEM AND APPARATUS FOR ENHANCED SUPPORT, STORAGE, AND DISPLAY OF RECREATIONAL BOARDS

FIELD OF THE INVENTION

The present invention relates to support, storage, and display systems, and more particularly, to an enhanced support, storage, and display system for recreational boards.

BACKGROUND OF THE INVENTION

Snowboards, surfboards, skateboards, as well as other types of recreational boards (boards), are often considered awkward shapes for display. The most prolific method of displaying recreational boards includes prominently displaying a single board while "stacking" the remaining boards. The boards are stacked much like a deck of cards, requiring the customer to "shuffle" through the boards in order to visually inspect each board. Most often the case in retail locations, boards are stacked vertically, with a lower end resting on a flat surface to conserve floor space. Conserving floor space allows for increased inventory of boards. The boards may also be tiered, with their lower end resting on a pedestal or other shelf apparatus, effectively raising the vertical position of the display. For certain boards, raising the vertical position of the boards allows for easier access to the boards, increasing the ability of the customer to easily shuffle through the boards.

Stacking the boards operates much like other stacked goods. When the customer knows the specific board they wish purchase, unless the desired board happens to be at the top of the stack, the customer is required to shuffle through boards to locate the desired board. Similarly, a customer may already know the design of the board they wish to purchase through visual inspection, but the chances are substantial that the customer will still be forced to shuffle through the boards to locate the board desired. It may be that the retail location has the desired board in their inventory but the customer was not able to locate the board since it happened to be at the bottom of the stack, costing the retail location the potential sale. Additionally, stacking the boards may scuff or damage the surface of the boards as they are shuffled, reducing the marketability of the board and preventing the retail location from obtaining a full price for the board. Furthermore, by stacking the boards it is very difficult to visually notice if a board is missing from the retail location, potentially costing the retail location in sales for the lost boards.

SUMMARY OF THE INVENTION

The present invention is directed to an enhanced system for displaying recreational boards such that design aspects of the boards of the display are simultaneously visible. The enhanced system arranges the boards in either a substantially vertical or horizontal position such that at least a portion of the visual design of each board may be visually ascertained by a user prior to physically handling the board. The enhanced system prevents the need to shuffle through the recreational boards in order to locate a specific recreational board and allows for a faster assessment of the inventory available. In addition, the enhanced system assists in preventing damage to the surface of the recreational boards by separating each board by a distance. Furthermore, when a recreational board is removed from the enhanced system it is readily noticeable that a board has been removed by visual inspection.

The apparatus includes an elongated support member that extends perpendicular to the length of the boards. At least one mounting member is attached to the first elongated support member so that the first elongated support member is mountable to a substantially vertical surface. The mounting member may include brackets or other functional components for mounting the apparatus to various types of walls such as flat wall, slot (slat) wall, or grid wall. One end of at least one securing member is attached at an angle to the elongated support member. The second end of the securing member has a hooked portion that holds a left or right edge of a recreational board. Additional securing members are positioned a distance apart along the elongated support member so that the angles of and distances between the securing members are such that at least a portion of design features of each of the recreational boards are simultaneously visible.

DETAILED DESCRIPTION OF THE PREFERRED EMBODIMENT

Figure 1:
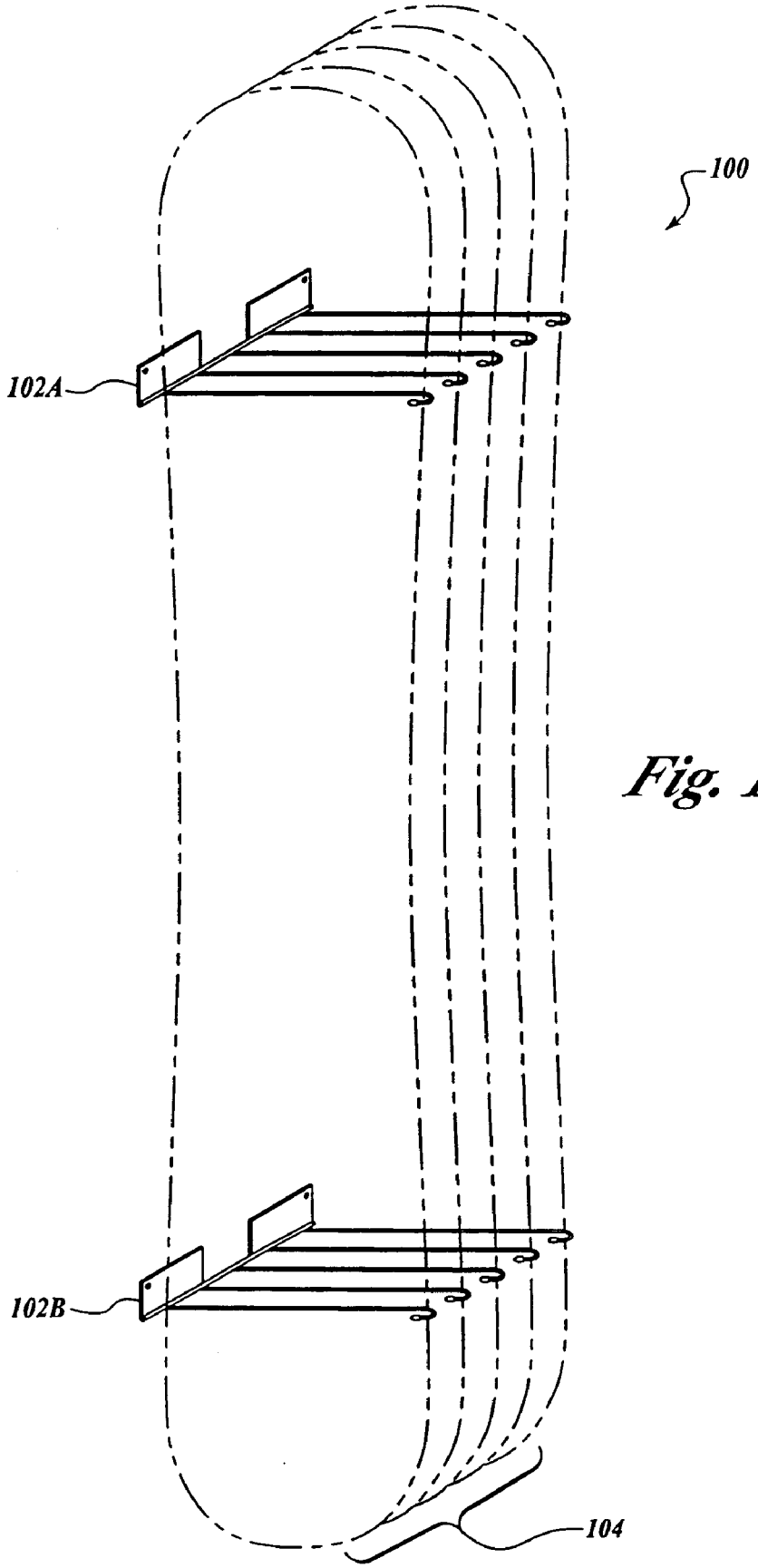
FIG. 1 illustrates an exemplary system for supporting, storing, and displaying recreational boards.

In the following detailed description of exemplary embodiments of the invention, reference is made to the accompanied drawings, which form a part hereof, and which is shown by way of illustration, specific exemplary embodiments of which the invention may be practiced. Each embodiment is described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise.

The terms "recreational boards" or "boards" refers to various types of boards that are used in recreational sports, including but not limited to, snowboards, surfboards, wakeboards, bodyboards, skis, skateboards, boogie boards, skimboards, and the like. The term "edge" refers to the perimeter contact surface of a recreational board. Typically, recreational boards are substantially planar and have an associated length and width. Often, the recreational board is substantially rectangular in shape and has a relatively thin thickness in comparison to its length and width. A recreational board includes at least a left edge and a right edge along two sides of its length. At the two ends, the end orientated towards the rear is the "tail" and the towards the front is the "tip". In some cases, the tip and tail may also have an edge along their respective perimeter contact surfaces.

The board includes a top surface and a bottom surface, wherein the bottom surface is typically a substantially smooth continuous surface that is designed to interface well with some medium (e.g., snow, water, or air). The bottom surface may also include points of attachment for functional elements such as fins, in the case of surfboards and the like, or wheels in the case of skateboards and the like. The top surface is the surface that a user is in contact with when the recreational board is used. Certain boards, such as snowboards and skies, include tip and/or tail portions that are curved away from the bottom surface, the top surface may include points of attachment for functional elements such as bindings. Also, certain boards may be bi-directional, twin-tipped, and/or substantially square shaped, in which case, the orientation of the tip of the board and the tail of the board may be interchangeable.

The term "design features" refers to the both shape of the recreational board and the ornamental colors, graphics, pictures, marks, shapes, and the like that may be applied to either the top or bottom surfaces of the recreational board. The visual appeal of a recreational board is often due to these design features, and hence its marketability depends in part on being visible when displayed for purchase. For example, a snowboard of a particular brand and model may have a different shape than another snowboard of the same brand and model. In some cases, the manufacturer may use a different color for recreational boards of different sizes and shapes.

The term "rack" refers to an apparatus for supporting and displaying recreational boards. In some embodiments, a support and display system may be comprised of multiple racks. In one example, a first rack may be used to support the upper portion of a recreational board and a second rack may be used to support the bottom portion of the board.

The phrase "substantial horizontal position" refers to an orientation that is within a range (for example, ±20 degrees) of the horizon line. The phrase "substantial vertical position" refers to an orientation that is within a range (for example, ±20 degrees) of 90 degrees from the horizon line. The phrase "substantially perpendicular refers to an orientation that is within a range (for example, ±20 degrees) of 90 degrees from the orientation of a reference.

Referring to the drawings, like numbers indicate like parts throughout the views. Additionally, a reference to the singular includes a reference to the plural unless otherwise stated or is inconsistent with the disclosure herein.

An apparatus is provided for supporting, storing, and displaying recreational boards so that at least a portion of a design feature for each board is simultaneously visually discernable. The apparatus is mountable to various types of surfaces using various mounting members. At least one of these mounting members is attached to an elongated support member that supports a number of securing members. The securing members have one end attached to the elongated support member and another end with a hooked portion for holding a right or left edge of the board at some position. The securing members are angled and spaced along the elongated support member to hold recreational boards in such a way that at least some of their design features are simultaneously visible.

FIG. 1 illustrates an exemplary enhanced system (100) for supporting, storing, and displaying recreational boards. The exemplary system includes two racks 102A and 102B that are explained in greater detail in the figures and discussion that follows. Recreational boards (104) are inserted into the exemplary system (100) and held in place by the racks (102A, 102B) such that the recreational boards (104) are relatively stationary unless physically removed. In the embodiment shown, the recreational boards (104) are shown as snowboards.

For removal, a left or right edge of the recreational board is slid along the securing member and away from the grip of their hooked portions (described in subsequent figures). Next, the position of the recreational board is moved away from the securing members and pulled outward from the elongated support member.

Recreational boards, such as snowboards or skis, may have sharp edges and can be a danger when falling from a vertical position. The racks (102A, 102B) create a relatively secure hold on the recreational boards and assist in preventing them from accidentally falling. The spacing and angle of the securing members (described in subsequent figures) allows for at least a portion of design features for each of the recreational boards (104) to be simultaneously visible, as can be seen in FIG. 1. A user can view at least a portion of the design features of the recreational boards (104) in the exemplary system (100) without physical contact. Simultaneous visual inspection also allows for initial determination of whether a recreational board (104) is missing from its position in the exemplary system (100), thereby improving theft detection and inventory determination.

In another embodiment, a greater or fewer number of racks (102A, 102B) may be used to support the recreational boards. Additional racks are combined in a vertically parallel arrangement to provide more support for recreational boards (104). For example, a surfboard tends to be of a greater size and weight in comparison to other types of recreational boards. In the case of a surfboard, additional racks may be required to support the full weight of the surfboard while maintaining stability. As shown in FIG. 1, one of the two racks (102A, 102B) is positioned vertically parallel from the other. A third rack (not shown) may also be positioned vertically parallel between the two racks (102A, 102B). Alternatively, in other applications, only a single rack may be used to support and display recreational boards.

The racks (102A, 102B) shown in FIG. 1 are mounted in a substantially horizontal position for supporting and displaying recreational boards in a substantially vertical position. In another embodiment, the exemplary system (100) may be rotated 90 degrees and mounted in a substantially vertical position for supporting and displaying recreational boards in a substantially horizontal position. In either orientation, the recreational boards are positioned with one edge substantially perpendicular to the racks (102A, 102B) when inserted into the exemplary system (100). In still other embodiments, the racks (102A, 102B) may be mounted in a variety of other orientations for supporting and displaying the recreational boards in an equal number of orientations with the only limit being practicable orientations (e.g., moving the racks into certain orientations may cause the recreational boards to fall from the racks).

Figure 2:
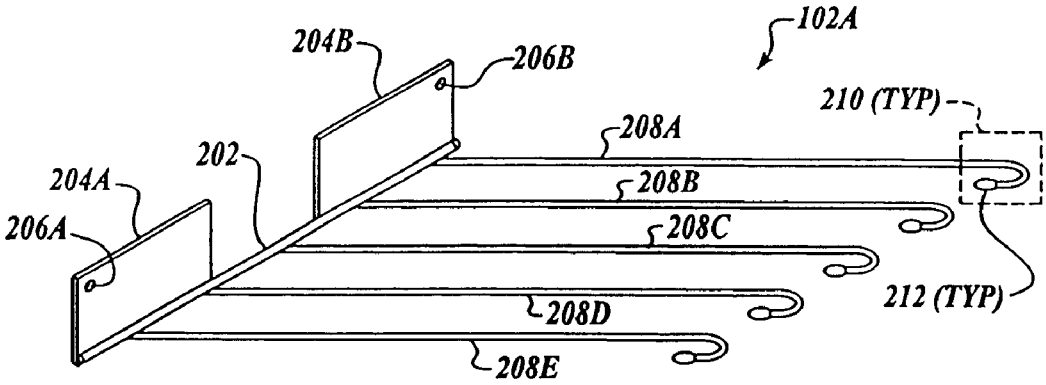
FIG. 2 shows an orthogonal view of an exemplary apparatus of the exemplary system shown in FIG. 1 for supporting and displaying recreational boards.

FIG. 2 shows an orthogonal view of an exemplary apparatus (102A) of the exemplary system (100) shown in FIG. 1 for supporting, storing, and displaying recreational boards. The exemplary apparatus (102A) includes an elongated support member (202), two mounting members (204A, 204B), and five securing members (208A–E). The mounting members (204A, 204B) include fastener holes (206A, 206B). Each of the five securing members (208A–E) include a hooked portion (210) and a cap (212).

Each mounting member (204A, 204B) is attached to the elongated support member (202). Each securing member (208A–E) is attached at an angle (e.g., 45 degrees) to the elongated support member (202) at one end. The amount of angle can be fixed or adjustable depending on the number of recreational boards held by the securing members and the amount of design features that are desired to be simultaneously visible. In other embodiments, the elongated support member 202, the mounting members (204A, 204B), and the securing members (208A–E) may be formed of a single composite component or may otherwise be interconnected to increase or decrease stability of the exemplary apparatus (102A) as required.

Figure 3:
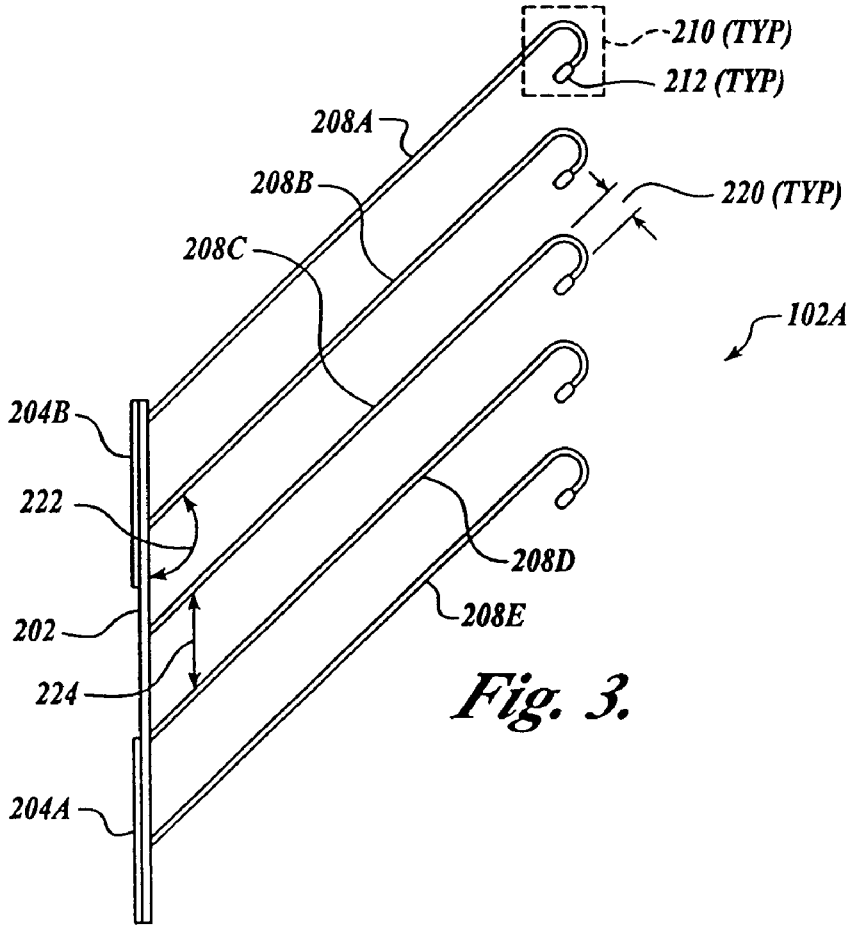
FIG. 3 illustrates a top-down view of the exemplary apparatus shown FIG. 2.

The mounting member (204A, 204B) shown in FIG. 3 is a substantially rectangular plate of moderate thickness that includes fastener holes (206A, 206B). In other embodiments, the mounting members may be other shapes, with a variety of thickness, that may increase or decrease the level of mounting stability as desired.

A screw, nail, rivet, bolt, clip, glue, and the like may be used to fasten the mounting members (204A, 204B) through the fastener holes (206A, 206B) to a flat wall. The placement or number of holes may be modified as required for increasing or decreasing the mounting stability of the exemplary apparatus (100). Other methods for mounting the exemplary apparatus to a substantially vertical surface are described in connection with FIGS. 5–10.

In the embodiment shown, each mounting member (204A, 204B) is attached at one end to the elongated support member (202) in a position that is substantially orthogonal to the orientation of each securing member (208A–E). In other embodiments, each mounting member (204A, 204B) may be attached to the elongated support member (202) at other points along the surface of the mounting member that may increase or decrease mounting stability.

In one embodiment, the mounting members (204A, 204B) and securing members (208A–E) are welded to the elongated support member (202). In yet another embodiment, the mounting, securing, and elongated support members may be extruded or cast as one complete assembly. In other embodiments, the mounting members (204A, 204B) and/or securing members (208A–E) may be fastened to the elongated support member (202) with screws, nails, rivets, bolts clips, glue, and the like. The mounting members (204A, 204B), securing members (208A–E), and elongated support member (202) may be separately made of different substances including metal, fiberglass, plastic, composite, and the like, or any other material of sufficient tensile strength to support and hold a particular type of recreational boards in a rack.

Optionally, a cap (212) of elastomeric material such as rubber, plastic and the like, may be placed over the ends of the securing members (208A–E). The cap protects the edges and surface of the recreational boards from the hooked ends of the securing members (208A–E) and increases the ability of the securing members (208A–E) to hold the boards in the rack (102A).

FIG. 3 illustrates a top-down view of the exemplary apparatus shown in FIG. 2. The top-down view illustrates a spacing (220) for the hooked portion (210) of each securing member (208A–E), an angle (222) at which each of the securing members (208A–E) are attached to the elongated support member (202), and a distance (224) between each securing member (208A–E).

In one embodiment, the spacing (220) for the hooked portion (210) between each securing member (208A–E) is fixed to accommodate the thickness of a particular type of recreational board. For example, surfboards are, in general, thicker than snowboards. Typically, the spacing (220) is set for a particular type of recreational board at the time the exemplary apparatus (102A) is manufactured. In another embodiment, each securing member (208A–E) is constructed of a material or in a manner that allows the spacing (220) to be adjusted after the exemplary apparatus (102A) is mounted on a substantially vertical surface.

The angle of (222) and distance between (224) each securing member (208A–E) attached to the elongated support member (202) is such that at least a portion of design features of each of the recreational boards is simultaneously available for visual inspection. In one embodiment, the distance (224) between each securing member (208A–E) is fixed to accommodate the thickness of a particular type of recreational board while still allowing a user to view a portion of a recreational board placed within the rack (102A). Typically, the distance (224) is set at the time the exemplary apparatus (102A) is manufactured. In another embodiment, each securing member (208A–E) is attached to the elongated support member (202) using a sliding member (not shown) that allows each securing member (208A–E) to slide along the length of the elongated support member (202) so that the distance (224) may be adjusted for different types of recreational boards with differing thicknesses after the exemplary apparatus (102A) is manufactured.

The angle (222) of each securing member (208A–E) to the elongated support member (202) assists in positioning outwards at least a portion of the top or bottom surfaces of recreational boards for simultaneous viewing by a user positioned in front of the exemplary apparatus (102A). In one embodiment, the angle (222) is adjusted at the time the exemplary apparatus (102A) is manufactured. In another embodiment, each securing member (208A–E) is attached to the elongated support member (202) using a rotating member (not shown) that allows each securing member (208A–E) to be rotated about an axis of attachment to the elongated support member, so that the angle (222) may be adjusted after the exemplary apparatus (102A) is mounted to a surface.

Figure 4:
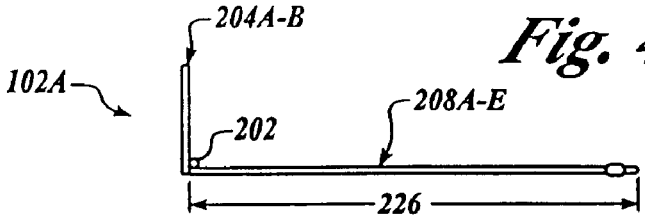
FIG. 4 shows a side view of the exemplary apparatus shown in FIG. 2.

FIG. 4 shows a side view of the exemplary apparatus shown in FIG. 2. The side view illustrates the mounting members (204A–B) attached at one end to the elongated support member (202). In another embodiment, the elongated member may be attached to the elongated support member at a different point, such as the mid-point of the mounting members (204A–B). In addition, each securing member (208A–E) is shown as having a substantially similar length (226). In one embodiment, the length (226) is adjusted at the time the exemplary apparatus (102A) is manufactured. In another embodiment, the length (226) of each securing member (208A–E) is separately adjustable after the exemplary apparatus (102A) is manufactured.

Figure 5:
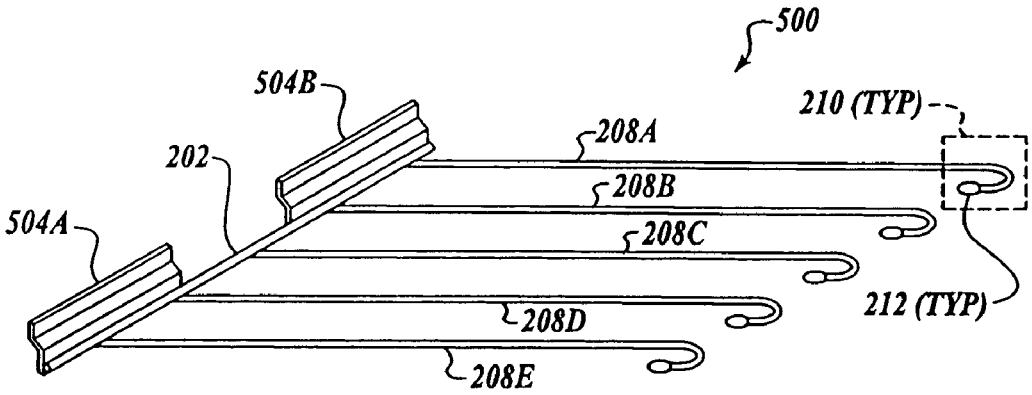
FIG. 5 illustrates an orthogonal view of an exemplary apparatus for supporting and displaying recreational boards with a mounting member for mounting the exemplary apparatus on a slot wall.
Figure 6:
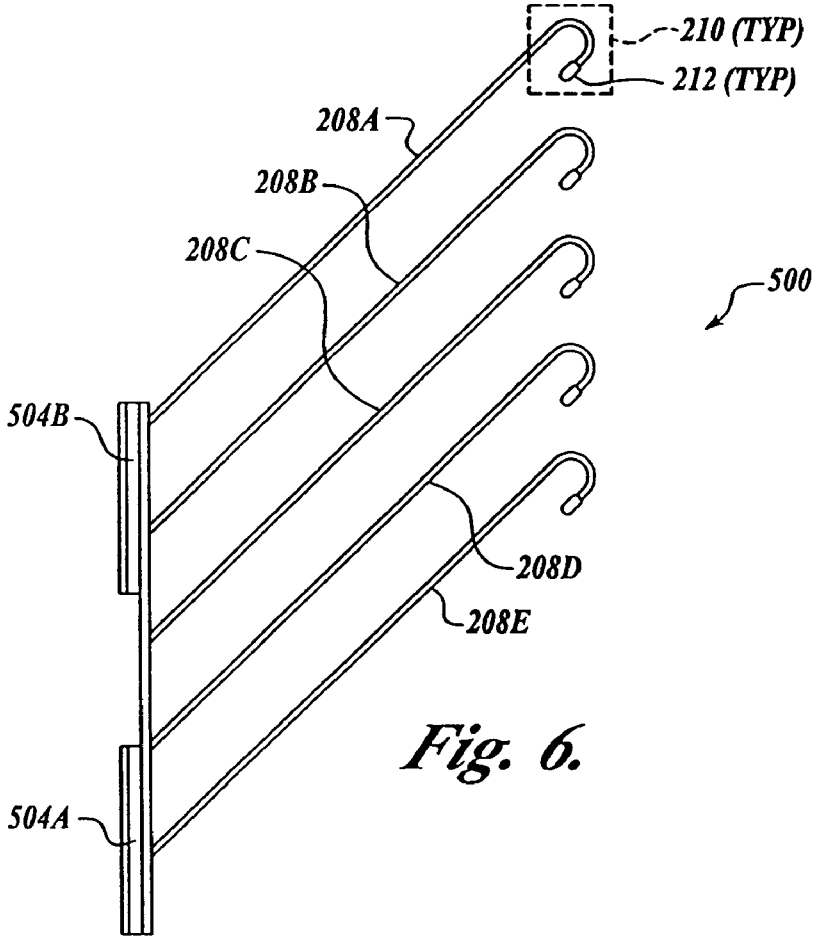
FIG. 6 shows a top-down view of the exemplary apparatus shown in FIG. 5.
Figure 7:
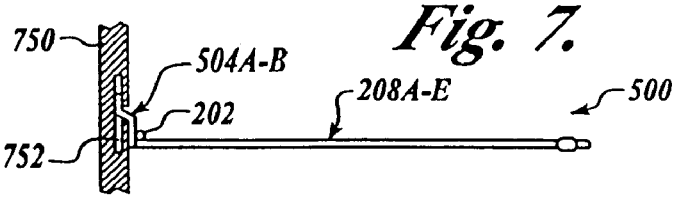
FIG. 7 illustrates a side view of the exemplary apparatus shown in FIG. 5 with the mounting members inserted into a slot wall section.

FIGS. 5–7 illustrate orthogonal (FIG. 5), top-down (FIG. 6), and side (FIG. 7) views of an exemplary apparatus (500) for supporting, storing, and displaying recreational boards that is substantially similar to the exemplary apparatus (102A) as shown in FIGS. 2–4. However, the exemplary apparatus (500) shown FIGS. 5–7 includes mounting members (504A–504B) for mounting the exemplary apparatus on a slot wall. Slot wall is a type of modular commercial display wall, sometimes referred to as slat wall, that includes "slots" in which the mounting members (504A–B) may be held. Examining the side view of FIG. 7, a section of slot wall (750) is included. Slots (e.g., 752) run the length of the slot wall (750) at different heights parallel to a floor or other horizontal surface. The mounting members (504A–B) are shaped such that the slot wall (750) accepts the mounting members (504A–B) in the slot (752) and supports the exemplary apparatus (500) at a height above the floor. Recreational boards inserted into the exemplary apparatus (500) are substantially adjacent to the slot wall (750) and supported by the exemplary apparatus (500).

Figure 8:
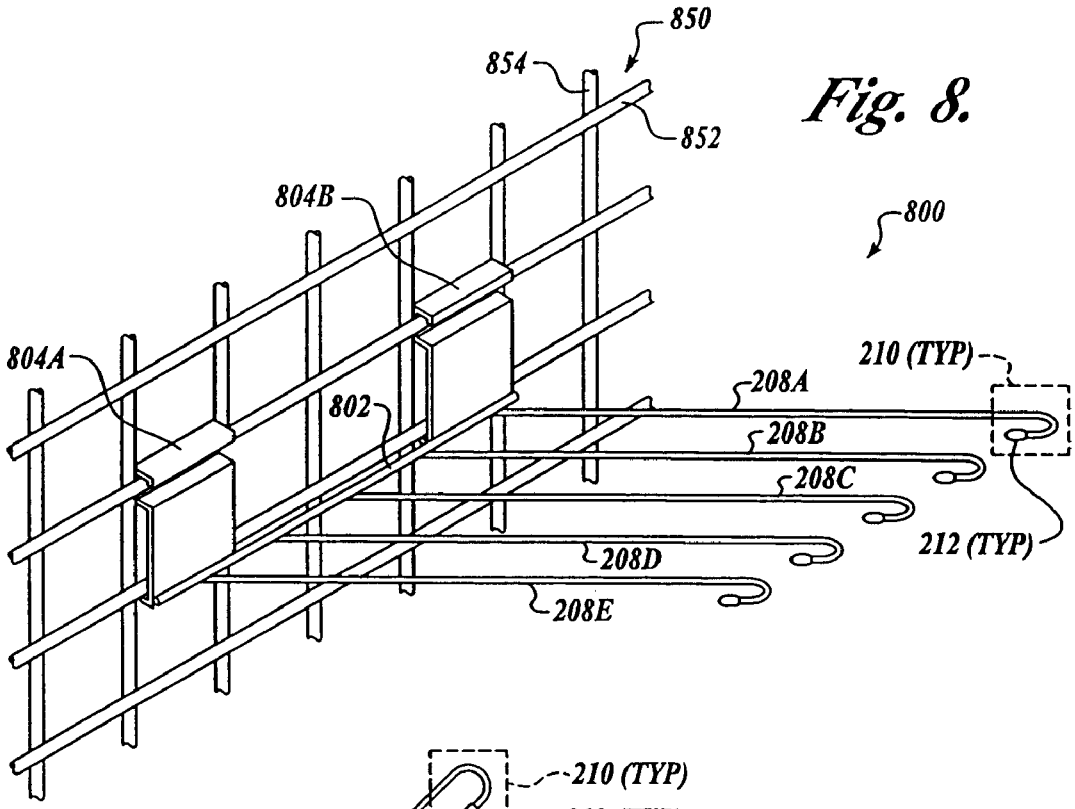
FIG. 8 shows an orthogonal view of an exemplary apparatus for supporting and displaying recreational boards mounted to a grid wall.
Figure 9:
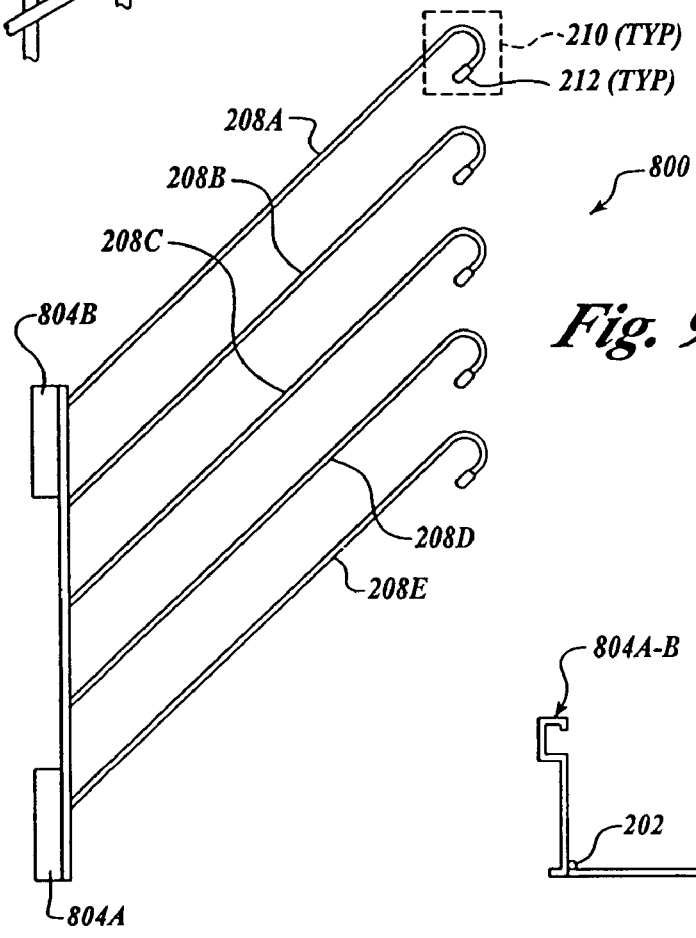
FIG. 9 illustrates a top-down view of the exemplary apparatus shown in FIG. 8.
Figure 10:
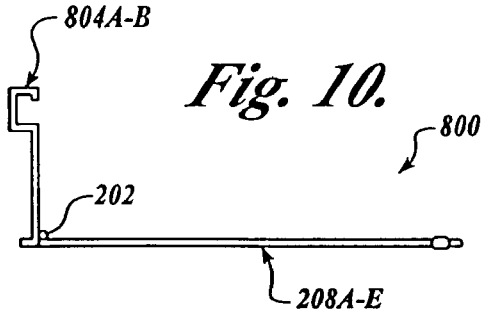
FIG. 10 shows a side view of the exemplary apparatus shown in FIG. 8, in accordance with the present invention.

FIGS. 8–10 illustrate orthogonal (FIG. 8), top-down (FIG. 9), and side (FIG. 10) views of an exemplary apparatus (800) for supporting, storing, and displaying recreational boards that is substantially similar to the exemplary apparatus (102A) shown in FIGS. 2–4. The exemplary apparatus (800) shown FIGS. 5–7, however includes mounting members (804A–804B) for mounting the exemplary apparatus on a grid wall (850). Grid wall is a type of modular commercial display wall (as shown in FIG. 8) that includes a "grid" of horizontal members (e.g., 852) interconnected with vertical members (e.g., 854) to which the mounting members (804A–B) may be attached as shown. Examining the side view of FIG. 10, the mounting members (804A–B) are shaped to be attached and supported by the grid wall (850). Recreational boards inserted into the exemplary apparatus (800) are substantially adjacent to the grid wall (850) and supported by the exemplary apparatus (800).

In each of the above FIGS. 1–10, the enhanced support and display system (100) illustrates each rack or exemplary apparatus (102A, 102B, 500, 800) as including five securing members (208A–E), two mounting members (204A–B, 504A–B, 804A–B), and a single elongated support member (202). In another embodiment, the number of securing members, mounting members, and elongated support members may be increased or decreased as desired. For example, a display wall of a retail location may have a certain width. The number of securing members may be chosen to fit the entire width of the wall or a portion of the width of the wall. The number of mounting members may then be selected to provide sufficient support for the number of securing members chosen.

In another embodiment, a second elongated support member (not shown) may be attached on the opposite side of each securing member (208A–E) from the elongated support member (202). Additional elongated support members increase the strength of the enhanced support and display system (100).

In FIGS. 1–10, the securing and elongated support members are shown as having the shape of substantially rounded or circular bars of material. In another embodiment, the securing members or the elongated support members may be substantially square, triangular, trapezoidal, rectangular, or any other shape. Additionally, the securing and elongated support members may be substantially hollow or solid for adjusting the weight or strength of each member.

In yet another embodiment, the enhanced support, storage, and display system may be attached to a substantially vertical surface that is not a wall, such as a kiosk or other freestanding structure that is located in the middle of a room or away from a wall. In yet a further embodiment, the enhanced support and display system may be incorporated on a moveable structure, such as a rack on wheels, so that the enhanced support and display system may be moved to various locations. By placing the enhanced support and display system on a moveable structure, the recreational boards may be placed in higher traffic areas, such as external display windows.

In still a further embodiment, two or more racks may be interconnected by one or more additional support members (not shown). The additional support member would combine two or more racks into a single enhanced support, storage, and display system. For example, two racks may be mounted vertically on a substantially vertical surface so that the recreational boards are supported and displayed in a substantially horizontal position. In this example, either the racks or the additional support member may include the mounting members for supporting the racks on the substantially vertical surface. According to this embodiment, the enhanced support, storage, and display system may include multiple racks that are interconnected.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus that is arranged to support and display recreational boards, comprising:

a first elongated support member that includes a length and a width at least one mounting member that is attached to the first elongated support member such that the first elongated support member is mountable to a substantially vertical surface by at least one mounting member;

a first securing member with a first end attached at a non-perpendicular angle to the first elongated support member relative to the length thereof and a second end having a first hooked portion that has a spacing adapted for holding a recreational board having an edge positioned within the first hooked portion and an opposite edge positioned substantially adjacent and perpendicular to the first elongated support member; and a second securing member positioned a distance from the first securing member along the first elongated support member, the second securing member having a first end attached at substantially the same angle to the first elongated support member and a second end having a second hooked portion with substantially the same spacing of the first securing member adapted for holding another recreational board having an edge positioned within the second hooked portion and an opposite edge positioned substantially adjacent and perpendicular to the first elongated support member, wherein the angles of and distances between the first and second securing members are such that at least a portion of design features for each of the recreational boards are simultaneously visible.

2. The apparatus of claim 1, wherein the first elongated support member is mounted to the substantially vertical surface in substantially a horizontal position such that the first securing member is in a relative position that is beside the second securing member.

3. The apparatus of claim 1, wherein the first elongated support member is mounted to the substantially vertical surface in substantially a vertical position such that the first securing member is in a relative position that is above the second securing member.

4. The apparatus of claim 1, wherein the mounting member includes a hole for mounting the first elongated support member with a fastener when the substantially vertical surface is a flat wall.

5. The apparatus of claim 1, wherein the mounting member is shaped such that a slot wall accents the mounting member.

6. The apparatus of claim 1, wherein the mounting member is shaped such that a grid wall accepts the mounting member.

7. The apparatus of claim 1, wherein first and second securing members have an associated coefficient of flexibility such that the second ends of the first and second securing members are moveable relative to a substantially stationary position of the first ends of the first and second securing members respectively.

8. The apparatus of claim 1, wherein the first end of each securing member is attached to the first elongated support member such that the angle is adjustable.

9. The apparatus of claim 1, further comprising:

a second elongated support member mounted substantially parallel a distance from the first elongated support member;

a third securing member attached to the second elongated support member that is the further distance from the first securing member in a substantially parallel position to the first securing member; and a fourth securing member attached to the second elongated support member that is the further distance from the second securing member in a substantially parallel position to the second securing member.

10. A method of manufacturing a rack for supporting and displaying recreational boards, comprising:

attaching at least one mounting member to a first elongated support member having a length and a width such that the first elongated support member is mountable to a substantially vertical surface by at least one mounting member;

attaching a first securing member to the first elongated support member at a non-perpendicular angle relative to the length thereof wherein the first securing member includes a hooked portion that has a spacing adapted to hold an edge of a recreational board; and attaching a second securing member to the first elongated support member at substantially the same angle to the elongated support member of the first securing member and at a distance from the first securing member such that at least a portion of design features of each of the recreational boards is simultaneously visible.

11. The method of claim 10, further comprising welding at least one of the mounting member, the first securing member, and the second securing member to the first elongated support member.

12. The method of claim 10, further comprising attaching the first and second securing members such that the angle of the first and second securing members to the elongated support member is adjustable.

13. The method of claim 10, further comprising affixing the mounting member substantially perpendicular to the first elongated support member such that the first elongated support member is mountable to a substantially vertical surface in a substantially horizontal position.

14. The method of claim 10, further comprising affixing the mounting member substantially parallel to the first elongated support member such that the first elongated support member is mountable to a substantially vertical surface in a substantially vertical position.

15. The method of claim 10, further comprising:

attaching at least one other mounting member to a second elongated support member such that the second elongated support member is mountable to the substantially vertical surface by the at least one other mounting member, wherein the second elongated support member is a distance from and substantially parallel to the first elongated support member;

attaching a third securing member to the second elongated support member at an angle to the second elongated support member and substantially parallel to the first securing member; and attaching a fourth securing member to the second elongated support member at substantially the same angle to the second elongated support member and substantially parallel to the second securing member.

16. A rack that is arranged to support and display recreational boards, comprising:

a means for supporting the recreational boards extending substantially perpendicular to the associated length of the recreational boards, said means for supporting having a length and a width a means for mounting the rack to a substantially vertical surface that is attached to the means for supporting;

a first means for securing a first recreational board attached at a non-perpendicular angle to the means for supporting, relative to the length thereof and having a first hooked means with a spacing adapted for holding an edge associated with the first recreational board; and a second means for securing a second recreational board attached at a non-perpendicular angle to the means for supporting, relative to the length thereof and having a second hooked means with a spacing adapted for holding an edge associated with the second recreational board, and the second means for securing is positioned a distance from the first securing means such that at least a portion of design features of each of the recreational boards is simultaneously visible.

17. The apparatus of claim 16, wherein the means for mounting the rack includes a hole for mounting the means for supporting with a fastening means when the substantially vertical surface is a flat wall.

18. The apparatus of claim 16, wherein the means for mounting the rack enables the means for supporting to be mountable when the substantially vertical surface is a slot wall.

19. The apparatus of claim 16, wherein the means for mounting the rack enables the means for supporting to be mountable when the substantially vertical surface is a grid wall.

* * * * *